US011193325B2

(12) United States Patent
Clark

(10) Patent No.: US 11,193,325 B2
(45) Date of Patent: Dec. 7, 2021

(54) TRAFFIC DOOR CONSTRUCTION AND METHOD OF MAKING SAME

(71) Applicant: Phoenix Door Systems LLC, Mason, OH (US)

(72) Inventor: Robert J. Clark, Cincinnati, OH (US)

(73) Assignee: Phoenix Door Systems LLC, Mason, OH (US)

( * ) Notice: Subject to any disclaimer, the term of this patent is extended or adjusted under 35 U.S.C. 154(b) by 70 days.

(21) Appl. No.: 16/408,697

(22) Filed: May 10, 2019

(65) Prior Publication Data

US 2020/0355020 A1 Nov. 12, 2020

(51) Int. Cl.

| | |
|---|---|
| ***E05B 1/00*** | (2006.01) |
| ***E06B 3/70*** | (2006.01) |
| ***E06B 5/00*** | (2006.01) |
| ***E06B 7/28*** | (2006.01) |

(52) U.S. Cl.

CPC ..... *E06B 3/7015* (2013.01); *E06B 5/00* (2013.01); *E06B 7/28* (2013.01)

(58) Field of Classification Search

CPC .. E06B 3/7015; E06B 3/86; E06B 2003/7023; E06B 5/00; E06B 3/72; E05D 7/081; E05D 7/00; E05Y 2900/132

USPC .... 49/397, 398, 381, 460, 383, 388; 52/316, 52/784.16, 314; 264/271.1, 466

See application file for complete search history.

(56) References Cited

U.S. PATENT DOCUMENTS

| | | | | | |
|---|---|---|---|---|---|
| 3,979,872 | A * | 9/1976 | Gilchrist | E06B 3/80 | 52/784.15 |
| 4,078,334 | A * | 3/1978 | Lambias | E05F 1/065 | 49/237 |
| 4,084,347 | A * | 4/1978 | Brown | E06B 3/86 | 49/368 |
| 4,570,384 | A * | 2/1986 | Eckel | E06B 7/362 | 160/354 |
| 4,686,806 | A | 8/1987 | Bennett | | |
| 4,945,606 | A * | 8/1990 | Eckel | E05F 1/065 | 16/250 |
| 5,265,311 | A | 11/1993 | Gard | | |
| 5,459,972 | A | 10/1995 | Eckel | | |
| 5,528,865 | A * | 6/1996 | Johnson | B29C 41/20 | 49/383 |
| 5,693,271 | A | 12/1997 | Johnson et al. | | |
| 6,029,409 | A * | 2/2000 | Wilson | E04G 21/30 | 150/154 |

(Continued)

*Primary Examiner* — Chi Q Nguyen

(74) *Attorney, Agent, or Firm* — Wood Herron & Evans LLP

(57) ABSTRACT

A frame for a traffic door having a leading edge, trailing edge, top edge, and bottom edge. The frame includes a trailing edge frame member having first and second ends and configured to extend along the trailing edge of the traffic door. The trailing edge frame member is a monolithic body having a first portion and a second portion, wherein the first portion extends between the first and second ends in a continuous and linear manner. The trailing edge frame member further includes a first cutout from the second portion of the trailing edge frame member adjacent the first end and a second cutout from the second portion of the trailing edge frame member adjacent the second end to define a central tab. A traffic door having such a frame is disclosed. A method of forming a traffic door with such a frame is also disclosed.

26 Claims, 13 Drawing Sheets

(56) References Cited

U.S. PATENT DOCUMENTS

| | | | | |
|---|---|---|---|---|
| 6,308,474 | B1 * | 10/2001 | Wilson | E04G 21/30 150/154 |
| 6,398,995 | B1 | 6/2002 | Eisenlord et al. | |
| 7,152,377 | B2 | 12/2006 | Falato et al. | |
| 7,526,894 | B2 | 5/2009 | Falato et al. | |
| 8,162,414 | B2 * | 4/2012 | Weiss | A47F 3/0434 312/138.1 |
| 2004/0107672 | A1 * | 6/2004 | Falato | B29C 41/04 52/784.1 |

* cited by examiner

TRAFFIC DOOR CONSTRUCTION AND METHOD OF MAKING SAME

TECHNICAL FIELD

This disclosure relates generally to traffic doors, and more particularly to a traffic door having a new and improved design, and a method of making a traffic door having such an improved construction.

BACKGROUND

Traffic doors are two-way swinging doors commonly used in industrial and commercial settings to provide access between different portions of a facility. The doors are generally biased to a closed position and can be moved to an opened position manually or by impact with material handling equipment, such as fork lift trucks, hand trucks, shopping carts, etc. As such, traffic doors have to be designed with sufficient strength and resiliency to withstand repeated impacts during operation.

Many traffic doors have a construction that includes an internal frame, a pair of face sheets on opposing sides of the frame, and a filler material disposed within the frame and between the opposing face sheets. The filler material may operate as a sound-absorbing medium, impact-absorbing medium, and/or thermal barrier medium. For example, the filler material may be inserts formed by foam, fiberglass or other sound, impact, or thermal mediums. The traffic door may include a window that allows personnel to see through the traffic door. Additionally, the traffic door is mounted to the door jamb through a spine that forms at least part of a self-closing door hinge. In this regard, the door jamb typically includes a jamb bushing and the traffic door typically includes a pivot post. The pivot post interacts with the jamb bushing through a cam arrangement that biases the traffic door to the closed position. When the traffic door is opened, opposing cam faces on the cam arrangement interact to cause the pivot post and traffic door to elevate or move upwardly relative to the closed position. When the door is released from the opened position, the weight of the door causes the door to drop back to the lower, more stable position as the door moves back toward the closed position.

While traffic doors as described above are generally successful for their intended purpose and operation, there are some deficiencies which manufacturers continually strive to improve upon. By way of example, manufacturers strive to provide traffic doors with an increased operating life. Because traffic doors are designed to absorb repeated impacts from material handling equipment, the operating life of a traffic door may be relatively low. Additionally, operators of material handling equipment often ignore guidelines for using the traffic doors that result in higher than expected impacts. In this regard, a relatively common failure mode of traffic doors is the formation of a crack near the rear edge of the traffic door where the spine is mounted to the door. As the traffic door continues to absorb impacts, the crack begins to grow and extends into the body of the door. Eventually, the traffic door becomes inoperable and must be replaced.

FIG. 1 illustrates a traffic door 10 in accordance with the prior art. As illustrated in this figure, a rear edge 12 of the traffic door 10 typically includes cutouts 14, 16 adjacent the upper edge 18 and lower edge 20, respectively, of the traffic door 10. As shown, the cutouts 14, 16 result in an intermediate projection or tab 22 along the central portion of the rear edge 12. These cutouts 14, 16 are configured to provide clearance for upper and lower jamb mounts that support the traffic door 10 in the doorway (not shown). The rear edge 12 of the traffic door 10 then has a step formed therein. The intersection of the intermediate tab 22 with the cutouts 14, 16 forms a sharp corner 24 at both the upper end and lower end of the tab 22. To strengthen the rear edge 12, the internal frame may include frame elements 26 that essentially extend along the stepped rear edge 12 of the traffic door 10. Thus, the frame elements 26 along the rear edge 12 also form sharp corners. The sharp corners formed at the juncture of the intermediate tab 22 and upper and lower cutouts 14, 16 in both the face sheets 28 and the frame elements 26 operate as stress concentration points (i.e., weak points) that ultimately crack during use of the traffic door 10.

Accordingly, there is a need for a traffic door having an improved construction that accommodates repeated impacts from material handling equipment in such a manner as to avoid or reduce the likelihood of failure and thereby extend the operational life of the traffic door. A method of making such an improved traffic door is also desired.

SUMMARY

A frame for a traffic door having a leading edge, a trailing edge, a top edge, and a bottom edge, wherein the trailing edge is configured to couple to a hinge mechanism for mounting the traffic door to a doorway is disclosed. The frame includes a trailing edge frame member having a first end and a second end and is configured to extend along the trailing edge of the traffic door. In accordance with an aspect of the disclosure, the trailing edge frame member may be formed by a monolithic body that defines a first portion and a second portion. The first portion extends between the first end and second end in a continuous and linear manner. The trailing edge frame member may further include a first cutout from the second portion of the trailing edge frame member adjacent the first end and a second cutout from the second portion of the trailing edge frame member adjacent the second end to define a central tab projecting away from the first portion.

In one embodiment, the trailing edge frame member may be formed by a tubular beam (e.g., an extruded tubular beam) having a central web, wherein the portion of the tubular beam to one side of the central web defines the first portion of the trailing edge frame member, and the portion of the tubular beam to the other side of the central web defines the second portion of the trailing edge frame member. An internal support may be positioned in the first portion of the trailing edge frame member to provide additional strength. Furthermore, the internal support may define at least one cavity in the first portion of the trailing edge frame member configured to receive a fixation bracket.

In an exemplary embodiment, the frame further includes a leading edge frame member, a top edge frame member, and a bottom edge frame member configured to respectively extend along the leading edge, top edge, and bottom edge of the traffic door. The leading edge frame member, top edge frame member, and bottom edge frame member may each be formed by a tubular beam having the same cross-sectional profile. The cross-sectional profile of the tubular beam that forms each of the leading edge frame member, top edge frame member, and bottom edge frame member may include an interior cavity and a slot through a wall of the tubular beam open to the cavity. The cavity may be configured to receive a seal having a portion that extends through the slot. Additionally, the cross-sectional profile of the tubular beam that forms each of the leading edge frame member, top edge frame member, and bottom edge frame member may further include at least one additional cavity configured to receive a fixation bracket.

In an exemplary embodiment, the leading edge frame member, trailing edge frame member, top edge frame member, and bottom edge frame member may be coupled together to form a peripheral frame portion. Moreover, the frame may include an interior frame portion positioned within and coupled to the peripheral frame portion. The interior frame portion may include a plurality of supports that form a frame of a window for the traffic door. Additionally or alternatively, the interior frame portion may include a plurality of supports for attachment of one or more bumpers for the traffic door. Still further, the supports may be used to provide additional strength.

In another embodiment, a traffic door having a leading edge, a trailing edge, a top edge and a bottom edge is disclosed. The traffic door includes a frame as described above, a filler material positioned within the frame, a first face sheet coupled to a first side of the frame, and a second face sheet coupled to a second side of the frame. In one embodiment, when there is no interior frame portion, the filler material may include a single monolithic body that substantially fills the space between the peripheral frame and the first and second face sheets. In another embodiment, where there is an interior frame portion, the filler material may include a plurality of filler inserts each positioned within a respective one of the plurality of chambers defined by the frame. The traffic door may further include a window and/or one or more bumpers on the traffic door.

In yet another embodiment, a method of making a traffic door having a leading edge, a trailing edge, a top edge and a bottom edge is disclosed. The method includes assembling a frame that supports the traffic door. The frame includes a trailing edge frame member having a first end and a second end and configured to extend along the trailing edge of the traffic door. The trailing edge frame member may be a monolithic body that defines a first portion and a second portion, wherein the first portion extends between the first end and the second end in a continuous and linear manner. Moreover, the trailing edge frame member may include a first cutout from the second portion of the trailing edge frame member adjacent the first end and a second cutout from the second portion of the trailing edge frame member adjacent the second end to define a central tab projecting away from the first portion. The method may further include inserting a filler material within the frame, coupling a first face sheet to a first side of the frame, and coupling a second face sheet to a second side of the frame.

In an exemplary embodiment, the frame further includes a leading edge frame member, a top edge frame member, and a bottom edge frame member configured to respectively extend along the leading edge, top edge, and bottom edge of the traffic door, wherein assembling the frame further includes coupling the leading edge frame member, trailing edge frame member, top edge frame member, and bottom edge frame member together to form a peripheral frame portion. In this embodiment, inserting the filler material within the frame may further include injecting a flowable filler material into the space defined by the peripheral frame and the first and second face sheets. In another embodiment, assembling the frame may further include forming an interior frame portion within the peripheral frame portion to define a plurality of chambers. In this embodiment, inserting the filler material within the frame further includes inserting filler inserts within at least some of the plurality of chambers.

In one embodiment, the method may further include attaching a seal to at least one of the leading edge frame member, top edge frame member, and bottom edge frame member. Additionally, the method may further include forming a first cutout from each of the first and second face sheets corresponding to the first cutout in the trailing edge frame member, and forming a second cutout from each of the first and second face sheets corresponding to the second cutout in the trailing edge frame member to define a central tab corresponding to the central tab of the trailing edge frame member. The formation of the cutouts in the face shafts may be done after being attached to the frame. In yet another embodiment, the method may further include forming a window through the traffic door and/or attaching one or more bumpers to at least one of the face sheets of the traffic door.

In a further embodiment, a method of making a frame member for a traffic door is disclosed. The method includes providing a tubular beam, such as an extruded tubular beam, having a first end and a second end, wherein the tubular beam is a monolithic body having a central web that defines a first portion and a second portion, wherein the first portion extends between the first end and the second end in a continuous and linear manner; forming a first cutout from the second portion of the trailing edge frame member adjacent the first end; and forming a second cutout from the second portion of the trailing edge frame member adjacent the second end to define a central tab projecting away from the first portion.

Additional features and advantages will be set forth in the detailed description which follows, and in part will be readily apparent to those skilled in the technical field of traffic doors. It is to be understood that the foregoing general description, the following detailed description, and the accompanying drawings are merely exemplary and intended to provide an overview or framework to understand the nature and character of the claims.

BRIEF DESCRIPTION OF THE DRAWINGS

The accompanying drawings are included to provide a further understanding and are incorporated in and constitute a part of this specification. The drawings illustrate one or more embodiment(s), and together with the description serve to explain principles and operation of the various embodiments. Features and attributes associated with any of the embodiments shown or described may be applied to other embodiments shown, described, or appreciated based on this disclosure.

DETAILED DESCRIPTION

Figure 2:
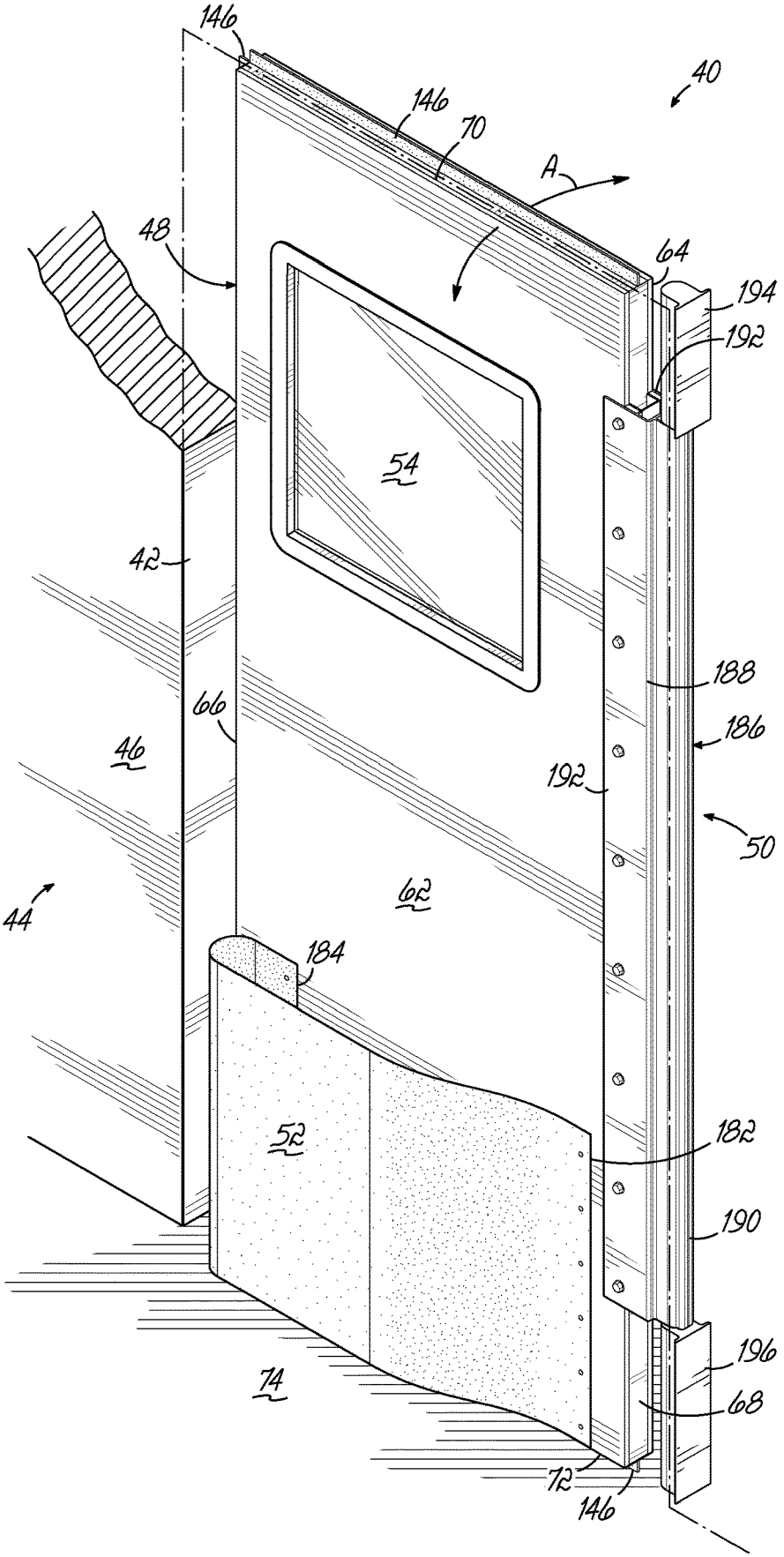
FIG. 2 is a front perspective view of a traffic door according to an embodiment of the present disclosure.

FIG. 2 illustrates a traffic door 40 in accordance with an exemplary embodiment having an improved construction that overcomes the shortcomings of many of the current traffic doors on the market. More particularly, the traffic door 40 includes a new and improved design that reduces the likelihood of early onset failure through crack initiation and propagation, and thereby extends the operating life of the traffic door 40 beyond that of conventional traffic doors. The traffic door 40 is shown in its normal operating environment within a doorway 42 at a facility 44. The facility 44 may be most any industrial or commercial setting where it is desirable to separate two regions of the facility 44, such as by a wall 46 or similar barrier, and provide selective access between the two regions via the doorway 42. The traffic door 40 includes a door body 48, as will be described in more detail below, and a hinge mechanism 50, including a hinge spine and several additional hinge components, may be coupled to the door body 48 for rotatably coupling the traffic door 40 to the doorway 42. The traffic door 40 is configured to be moved from a closed position (as illustrated in FIG. 2) to an opened position that provides access through the doorway 42 (not shown). More particularly, the traffic door 40 is configured to be rotatable in both directions, as illustrated by arrow A.

In use, material handling equipment (not shown), such as various fork lift trucks, hand trucks, shopping carts, etc., are configured to contact one of the major surfaces of the traffic door 40 (i.e., on either side of the door) in order to move the door 40 from the closed position to the opened position. In other words, the impact from the material handling equipment is the motive force that causes the traffic door 40 to move from the closed position to the opened position to thereby allow the material handling equipment to pass through the doorway 42. To this end, the traffic door 40 may include one or more bumpers 52 for absorbing at least some of the impact from the material handling equipment as it contacts the traffic door 40. For example, each side of the traffic door 40 may include one or more bumpers 52. The hinge mechanism 50 biases the traffic door 40 toward the closed position such that after the material handling equipment passes through the doorway 42, the traffic door 40 moves back to the closed position under the bias from the hinge mechanism 50. Additionally, in an exemplary embodiment and as illustrated in FIG. 2, to provide some visibility through the traffic door 40, the door 40 may be provided with a window 54.

FIGS. 3-12 illustrate views of the traffic door 40 in accordance with an exemplary embodiment of the disclosure. The traffic door 40 includes a door body 48 having a generally laminate construction. The door body 48 includes a frame 58, internal filler material 60 disposed generally within the frame 58, and a pair of face sheets 62, 64 on opposing sides of the frame 58 and generally enclosing the filler material 60. The door body components 58, 60, 62 and 64 may be coupled together, in a manner described in more detail below, to form an assembly that collectively defines the traffic door 40. The traffic door 40 generally includes a leading edge 66, a trailing edge 68, a top edge 70 and a bottom edge 72. As illustrated in FIG. 2, the top edge 70 generally confronts the top of the doorway 42, the bottom edge 72 generally confronts the floor 74 of the facility 44, the trailing edge 68 generally confronts the door jamb of the doorway 42 to which the hinge mechanism 50 is coupled, and the leading edge 66 generally confronts the opposing door jamb of the doorway 42 (or another traffic door if used in pairs). Similar to prior designs, the trailing edge 68 of the traffic door 40 may include an upper cutout 76 adjacent the top edge 70 and a lower cutout 78 adjacent the bottom edge 72 to define a central tab 80 therebetween.

Figure 6:
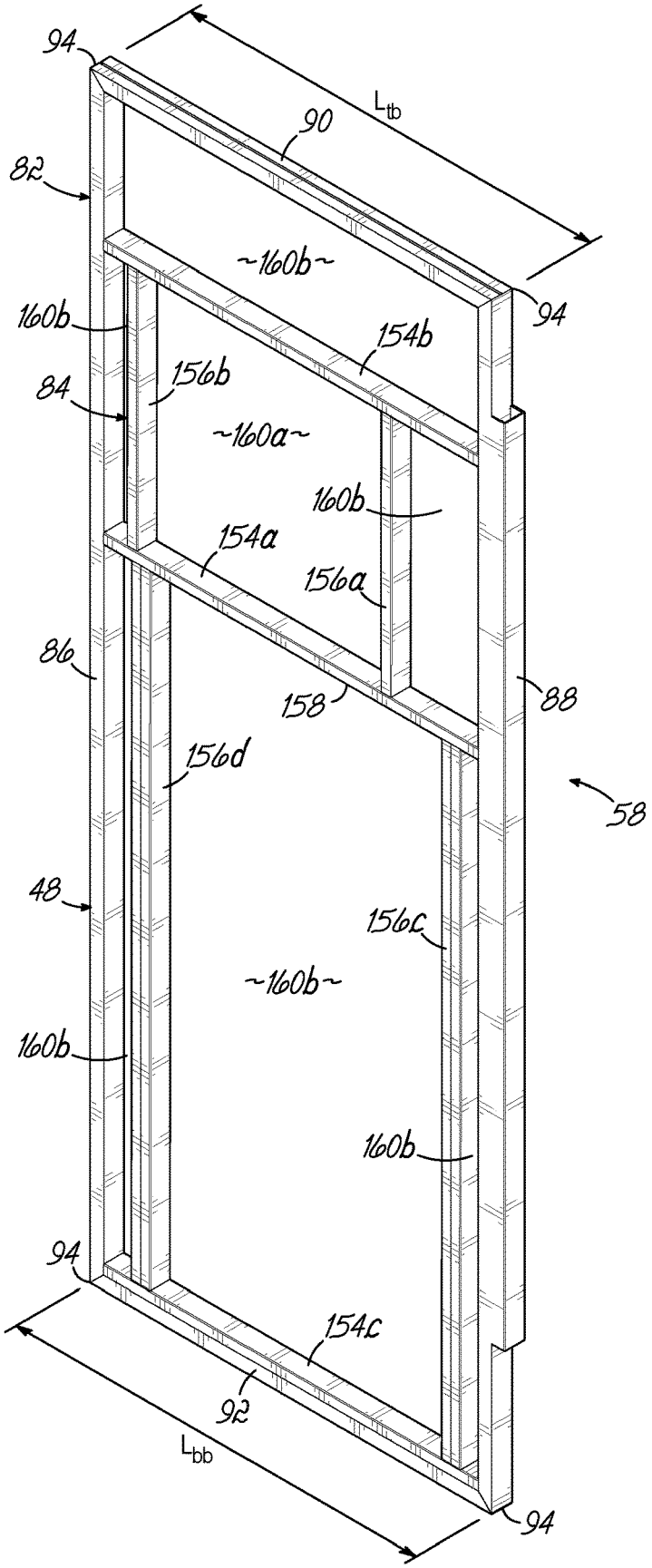
FIG. 6 is a front perspective view of a frame for the traffic door shown in FIGS. 2-5.
Figure 7:
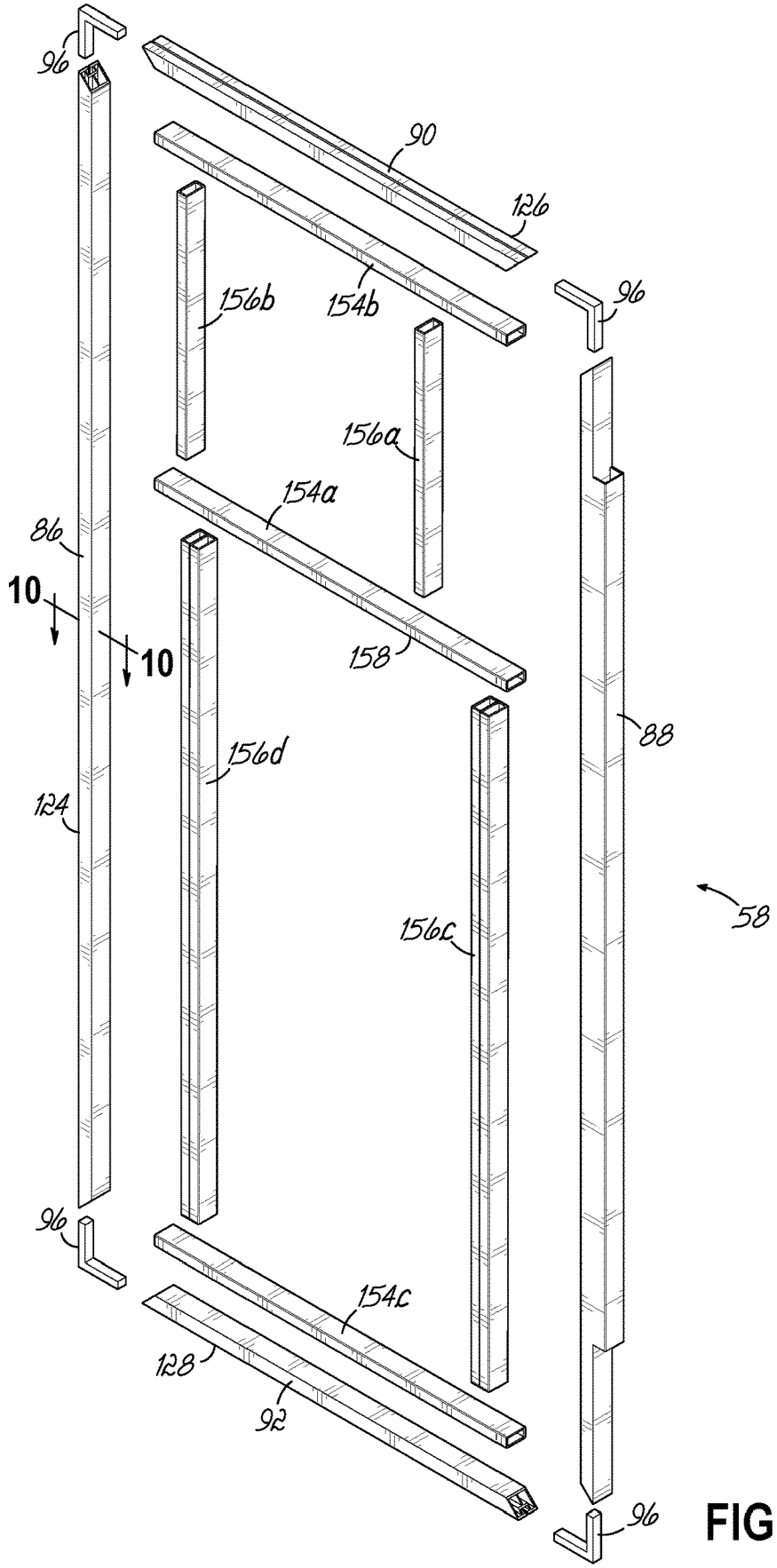
FIG. 7 is a front perspective disassembled view of the frame shown in FIG. 6.

FIGS. 6 and 7 respectively illustrate an assembled view and a disassembled view of the frame 58 of the traffic door 40 in accordance with an embodiment of the disclosure. The frame 58 has a generally rectangular configuration and includes a peripheral frame portion 82 and an interior frame portion 84 disposed generally within the peripheral frame portion 82. The peripheral frame portion 82 generally defines the outer boundary of the frame 58 and includes a leading edge frame member 86, a trailing edge frame member 88, a top edge frame member 90 and a bottom edge frame member 92. The frame members 86, 88, 90, 92 may be coupled together at their ends, such as at mitered joints 94. By way of example, the frame members 86, 88, 90, 92 may be bonded together with a bonding agent, such as with an epoxy resin. Other bonding agents may, however, be used to couple the frame members 86, 88, 90, 92 together. Alternatively, the frame members 86, 88, 90, 92 may be coupled together in other ways, including various welding techniques, such as ultrasonic welding, for example. Additionally, L-shaped brackets 96 may be used to fix the relative positions of the frame members 86, 88, 90, 92 during, for example, the bonding process of the peripheral frame members 86, 88, 90, 92.

Figure 8:
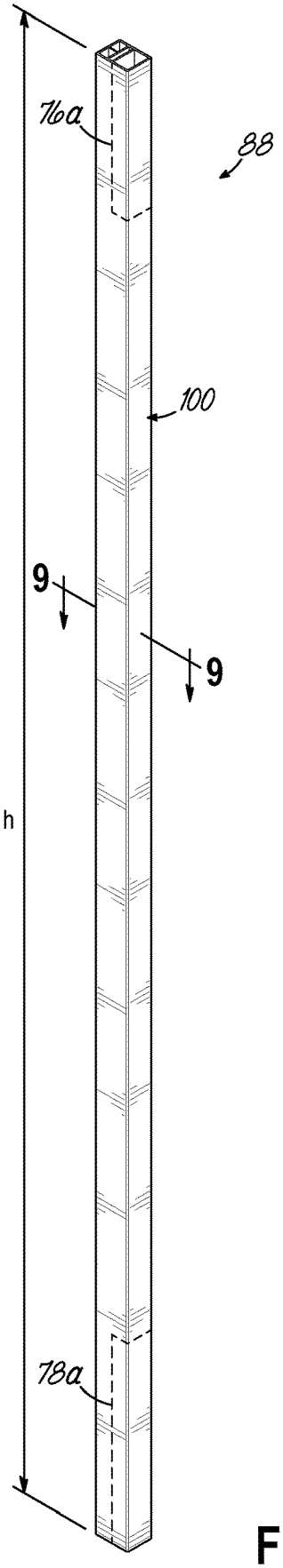
FIG. 8 is a front perspective view of a trailing edge frame member in accordance with an embodiment of the disclosure.
Figure 8A:
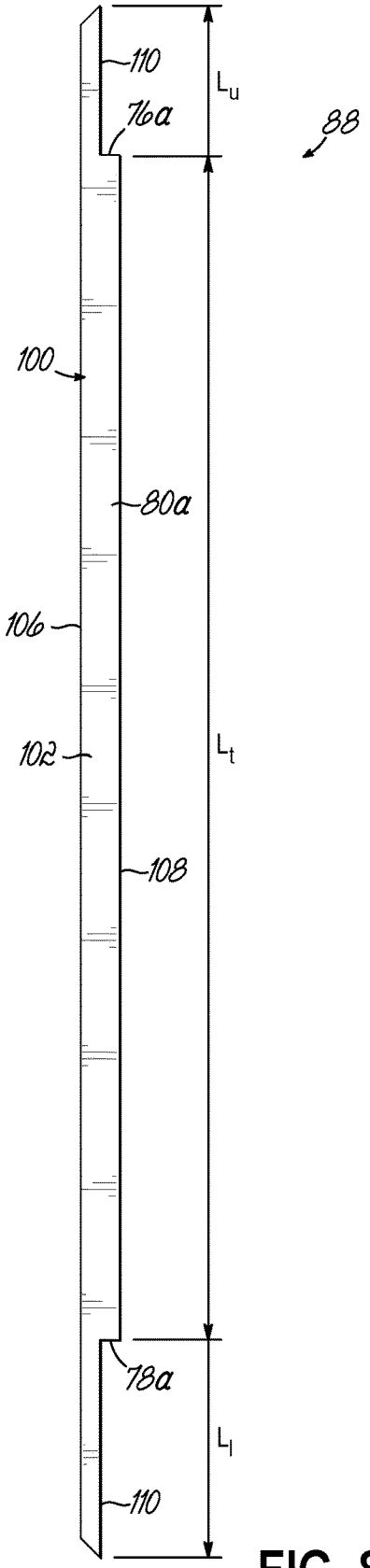
FIG. 8A is a front plan view of the trailing edge frame member shown in FIG. 8.
Figure 9:
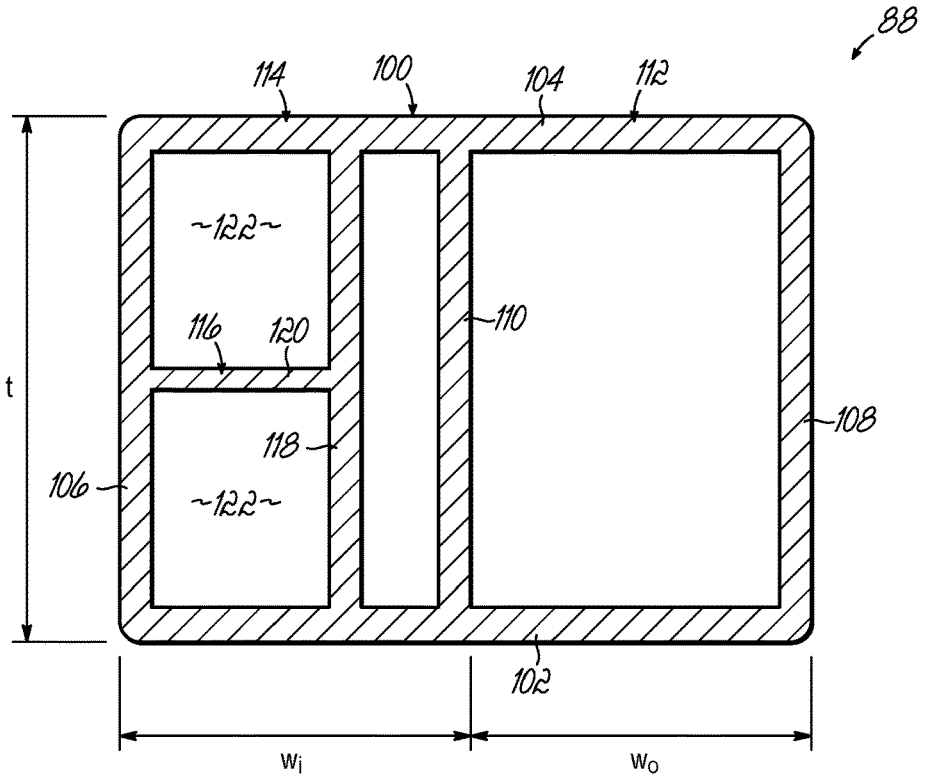
FIG. 9 is a cross-sectional view of the trailing edge frame member shown in FIG. 8.

In accordance with an aspect of the present invention, the trailing edge frame member 88 has been redesigned to provide added strength to the trailing edge 68 of the traffic door 40, and thereby avoid the initiation of cracks in the traffic door 40 during use. As best illustrated in FIGS. 8, 8A and 9, the trailing edge frame member 88 includes an elongate tubular beam 100 having a generally rectangular cross-sectional profile that generally defines a front wall 102, a rear wall 104, an inner side wall 106 and an outer side wall 108. Moreover, the tubular beam 100 includes a central web 110 extending between the front and rear walls 102, 104 that defines an outer tubular portion 112 and an inner tubular portion 114. The central web 110 is selectively positioned between the inner and outer side walls 106, 108 such that the width $w_o$ of the outer tubular portion 112 generally corresponds to the depth of the cutouts 76, 78 formed in the traffic door 40. Stated in a slightly different way, the width $w_o$ of the outer tubular portion 112 generally corresponds to the width of the central tab 80 in the trailing edge 68 of the traffic door 40. By way of example and without limitation, the width $w_o$ of the outer tubular portion 112 may be between about 0.8 inches to about 1.2 inches. In one exemplary embodiment, the width $w_o$ of the outer tubular portion 112 may be about 1.0 inches (+/−5%). This width may be dictated by the clearance necessary to mount the traffic door 40 to the doorway 42 via the hinge mechanism 50. Such clearance distances may depend on the particular hinge mechanism but are readily known or determinable by those of ordinary skill in the art.

The width $w_i$ of the inner tubular portion 114 is typically selected to match the width of the frame members used in conventional traffic doors. By way of example and without limitation, many conventional traffic doors use a frame formed from beams having a width of about 1.0 inches. Thus, the width of the inner tubular portion 114 may be between about 0.8 inches and about 1.2 inches. In one exemplary embodiment, the width $w_i$ of the inner tubular portion 114 may be about 1.0 inches (+/−5%). Thus, in an exemplary embodiment the central web 110 may be positioned approximately at the midpoint of the total width of the tubular beam 100. It should be recognized that the dimensions provided above are exemplary and that other dimensions are possible depending on the particular application, and that such alternative configurations remain within the scope of the present disclosure.

As best illustrated in FIG. 9, the inner tubular portion 114 includes an internal T-shaped support 116 having a first web 118 extending between front and rear walls 102, 104 and a second web 120 extending between the inner side wall 106 and the first web 118. The support 116 is configured to provide additional strength to the tubular beam 100 along the inner tubular portion 114. The thickness t of the tubular beam 100 may be between about 1.0 inches and about 2.0 inches. In an exemplary embodiment, the thickness t of the tubular beam 100 may be about 1.5 inches (+/−5%). Moreover, the second web 120 may be positioned at about the midpoint of the thickness t of the tubular beam 100. It should be recognized that the dimensions provided above are exemplary and that other dimensions are possible depending on the particular application, and that such alternative configurations remain within the scope of the present disclosure. For example, it should be recognized that the support 116 may include a plurality of webs 118 between the front and rear walls 102, 104 and a plurality of webs 120 extending between the inner side wall 106 and an adjacent web 118 or between adjacent webs 118. In any event, the internal support 116 defines a plurality of rectangular cavities 122. As explained in more detail below, one or more of the cavities 122 may be configured to receive an L-shaped bracket 96 that helps fix the frame 58 together during the assembly of the frame 58.

The height h of the tubular beam 100 that forms the trailing edge frame member 88 depends on the size of the doorway 42 and may be adjusted to fit the particular dimensions of the doorway 42. In the normal course, doorways 42 may have a standard height to meet certain local or regional building codes. In an exemplary embodiment, for example, the traffic door 40 may be configured to have a height of about 80 inches (+/−5%). For example, in one embodiment, the traffic door 40 may have a height of about 81.0 inches. This dimension is exemplary and it should be recognized that other heights are possible and remain within the scope of the present disclosure. In any event, the trailing edge frame member 88 may be configured to have a height that corresponds to the height of the traffic door 40. In other words, the trailing edge frame member 88 may extend the full height of the traffic door 40. Thus, in an exemplary embodiment, the tubular beam 100 may have a height h of about 80 inches (+/−5%). In an alternative embodiment, the trailing edge frame member 88 may extend substantially the full height of the traffic door 40, such as 90%, preferably 95%, and even more preferably 98% or greater of the full height of the traffic door 40.

As illustrated in FIG. 8, the upper cutout 76 and lower cutout 78 of the traffic door 40 may be formed by corresponding cutouts 76*a*, 78*b* in the trailing edge frame member 88. These cutouts 76*a*, 78*a* may be formed by removing the outer side wall 108 and a portion of the front wall 102 and a portion of the rear wall 104 so as to expose the central web 110. For example, a saw or other suitable tool may be used to form the cutouts 76*a*, 78*a* in the tubular beam 100 that forms the trailing edge frame member 88. The length of the cutouts 76*a*, 78*a* along the tubular beam 100 may depend on the particular hinge mechanism 50 used to couple the traffic door 40 to the doorway 42. Generally, the lengths of the cutouts 76, 78 are selected to provide sufficient clearance for the hinge mechanism 50. In an exemplary embodiment, the upper cutout 76*a* may have a length $L_u$ of between about 5 inches and about 10 inches, more preferably between about 6 inches and 9 inches, and even more preferably between about 7 inches and 8 inches. The lower cutout 78*a* may have a length $L_l$ of between about 8 inches and about 14 inches, more preferably between about 9 inches and 13 inches, and even more preferably between about 11 inches and 12 inches. The formation of the cutouts 76*a*, 78*a* in the tubular beam 100 results in the formation of a central tab 80*a* that corresponds to the central tab 80 in the traffic door 40. The length $L_t$ of the central tab 80*a* is generally what remains after the lengths $L_u$ and $L_l$ of the cutouts 76*a*, 78*a* have been determined. In an exemplary embodiment, the length $L_t$ of the central tab 80*a* may be between about 56 inches and about 67 inches, and more particularly between about 60 inches and about 64 inches. In one embodiment, the length of the central tab 80*a* may be about 62 inches (+/−5%). Again, these dimensions are exemplary and may depend on the particular application.

In an exemplary embodiment, the trailing edge frame member 88 may be formed through an extrusion process using a suitable engineering plastic material. The extrusion process is well known to those of ordinary skill in the traffic door industry and a further description of such a process will not be provided herein. In an exemplary embodiment, the trailing edge frame member 88 may be formed from acrylonitrile butadiene styrene (ABS). However, other thermoplastic polymers may also be possible, including polyethylene (PE), polypropylene (PP), polyvinyl chloride (PVC), and other materials. A strip having the configuration of the tubular beam 100 may be provided in stock lengths, which strips are then cut to size to form the frame member 88 for a particular application.

It is believed that the configuration of the trailing edge frame member 88 provides improved strength performance for the traffic door 40. In particular, the trailing edge frame member 88 is an integral or monolithic body that includes a first portion (i.e., the inner tubular portion 114) that extends substantially the full length of the traffic door 40 from the bottom edge 72 to the top edge 70 in a substantially linear and continuous manner. In other words, there are no turns or sharp corners in the inner tubular portion 114 of the trailing edge frame member 88. Additionally, the central tab 80 of the traffic door 40 is formed by a second portion (i.e., the outer tubular portion 112 that remains after the formation of the cutouts 76*a*, 78*a*) that is integrally formed with the first portion. This is in stark contrast to the trailing edge frame member of conventional traffic doors, which include a plurality of separate frame members coupled together to define sharp corners that give the stepped profile indicative of the trailing edge of traffic doors.

Figure 1:
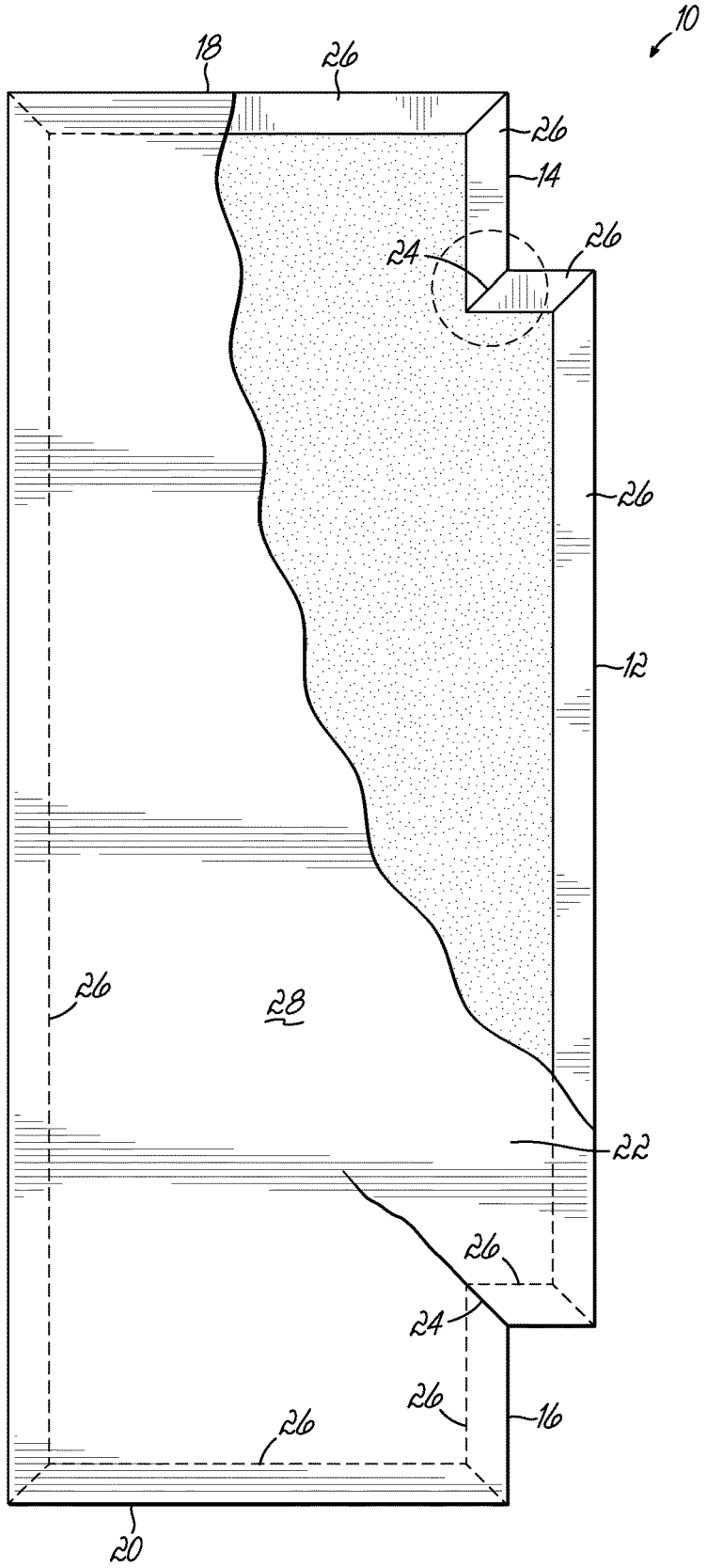
FIG. 1 PRIOR ART
FIG. 1 is a front plan view of a traffic door according to the prior art.

This distinction is best illustrated by comparing the trailing edge frame arrangement of the traffic door 10 shown in FIG. 1 and the trailing edge frame member 88 of the traffic door 40 illustrated, for example, in FIGS. 6 and 7. The inventors believe that by providing a trailing edge frame member having a first portion that extends substantially the full height of the traffic door in a substantially linear (e.g., straight), continuous and monolithic manner, and a second portion that forms the central tab and is integrally formed with the first portion (such that collectively the first and second portions form a monolith) the strength of the traffic door substantially improves and crack initiation and propagation that results in failure of the traffic door is avoided or delayed. For example, it is believed that a traffic door having a trailing edge frame member 88 as described above will increase the operating life of the traffic door in the normal course of usage between about 100% and about 200%. This is a significant improvement in performance and would be desirable by those that use and purchase traffic doors.

Figure 10:
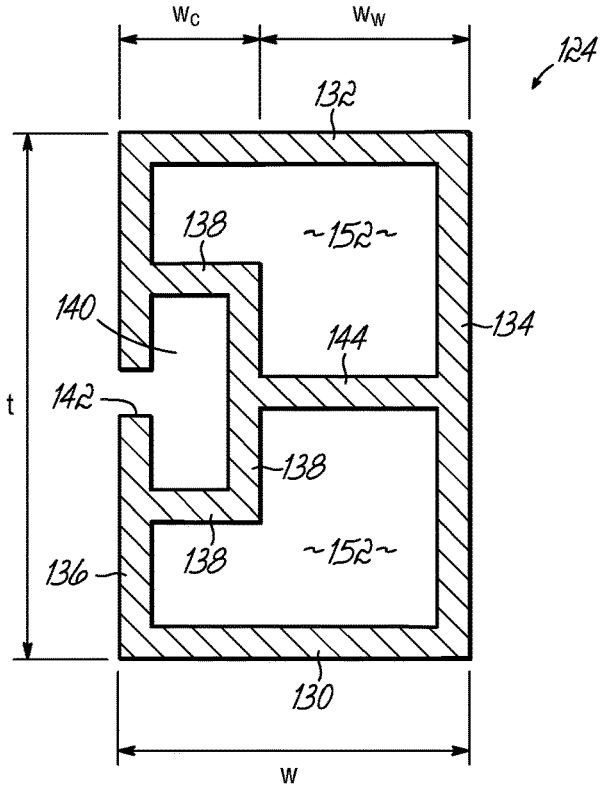
FIG. 10 is a cross-sectional view of the leading edge frame member shown in FIG. 6.

In reference to FIGS. 6 and 7, the remaining portion of the peripheral frame portion 82, including the leading edge frame member 86, the top edge frame member 90, and the bottom edge frame member 92 may each be formed from respective tubular beams 124, 126, 128. In one embodiment, each of the tubular beams 124, 126, 128 may have a generally rectangular cross-sectional profile. More particularly, in an exemplary embodiment, the tubular beams 124, 126, 128 may have the same cross-sectional profile and differ only in the length of the respective beams 124, 126, 128. As illustrated in FIG. 10 (shown for tubular beam 124 but applicable for tubular beams 126, 128), the tubular beam 124 generally defines a front wall 130, a rear wall 132, an inner side wall 134 and an outer side wall 136. The interior of the tubular beam 124 includes a plurality of webs 138 (e.g., three webs) that in combination with the outer side wall 136 form a generally rectangular cavity 140. The cavity 140 is generally centrally located along the thickness of the tubular beam 124 and extends for only a portion of the thickness and width of the tubular beam 124. The outer side wall 136 includes a slot 142 that extends through the thickness of the wall 136 and is in communication with the interior of the cavity 140. Moreover, one or more webs 144 may extend from the inner side wall 134 to the cavity 140 to provide additional strength to the tubular beam 124.

Figure 5:
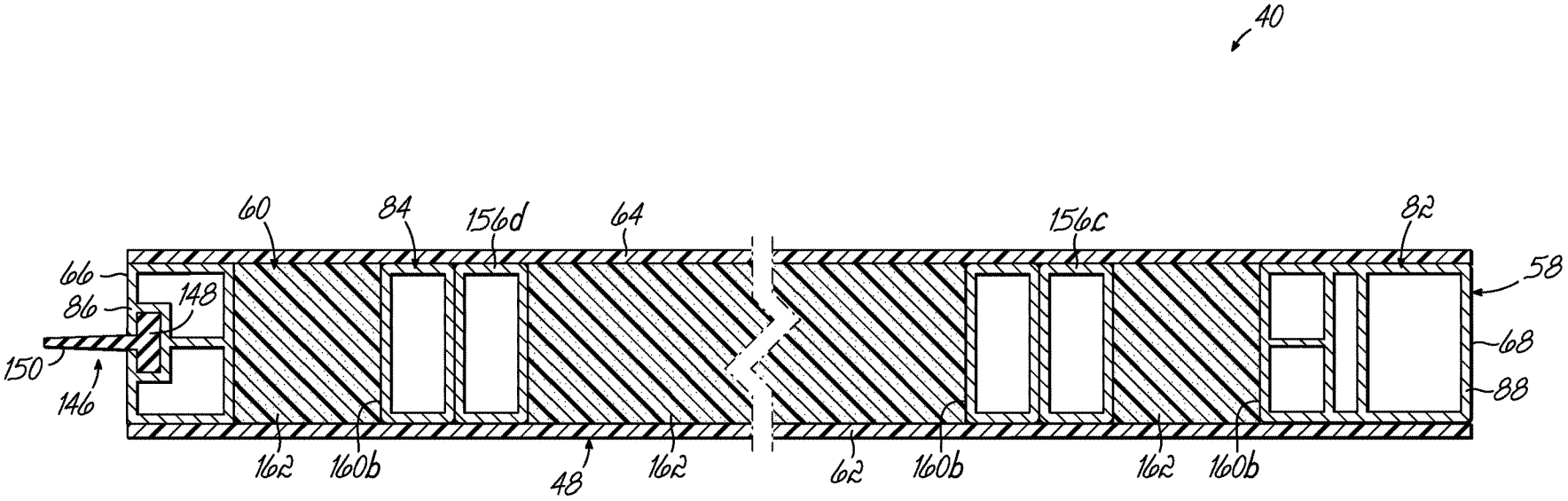
FIG. 5 is a cross-sectional view of the traffic door shown in FIG. 4.

As illustrated in FIG. 5, in an exemplary embodiment, the traffic door 40 may include a seal 146 around at least a portion of the periphery of the door 40. For example, a seal 146 may be provided along the leading edge 66, the top edge 70 and the bottom edge 72 of the traffic door 40. In this regard, the seal 146 may be coupled to the corresponding leading edge frame member 86, the top edge frame member 90 and the bottom edge frame member 92. In one embodiment, the seal 146 may be a lip seal having a base 148 configured to be received in the cavity 140 and a lip 150 that extends through the slot 142 and away from the outer side wall 136. It should be recognized that the tubular beam 124 may be configured to receive a wide range of seals, and aspects of the invention are not limited to a lip seal shown herein. It should be further recognized that the traffic door 40 may not include a seal at all. In this case, the slot 142 in the outer side wall 136 and internal webbing 138, 144 in the tubular beam 124 may be omitted. However, internal webbing may be provided for strength purposes.

Similar to the above, the width w of the tubular beam 124 may be selected to match the width of the frame members used on conventional traffic doors. By way of example and without limitation, the width of the tubular beam 124 may be between about 0.8 inches and about 1.2 inches. In one exemplary embodiment, the width w of the tubular beam 124 may be about 1.0 inches (+/−5%). In the exemplary embodiment, the cavity 140 may have a width $w_c$ of about 0.4 inches and the web 144 may have a width $w_w$ of about 0.6 inches. As further illustrated in FIG. 10, the thickness t of the tubular beam 124 may be between about 1.0 inches and about 2.0 inches. In an exemplary embodiment, the thickness of the tubular beam 124 may be about 1.5 inches (+/−5%). Moreover, cavity 140 and the web 144 may be positioned at about the midpoint of the thickness of the tubular beam 124. It should be recognized that the dimensions provided above are exemplary and that other dimensions are possible depending on the particular application, and that such alternative configurations remain within the scope of the present disclosure. In any event, the cavity 140 and web 144 define a plurality of rectangular cavities 152. As explained in more detail below, one or more of the cavities 152 may be configured to receive an L-shaped bracket 96 that helps fix the frame 58 together during the assembly of the frame 58.

Similar to the above for the trailing edge tubular beam 100, the height of the tubular beam 124 that forms the leading edge frame member 86 depends on the size of the doorway 42 and may be adjusted to fit the particular dimensions of the doorway 42. In an exemplary embodiment, for example, the traffic door 40 may be configured to have a height of about 80 inches (+/−5%). In one embodiment, the traffic door 40 may have a height of about 81.0 inches. This dimension is exemplary and it should be recognized that other heights are possible and remain within the scope of the present disclosure. In any event, the leading edge frame member 86 may be configured to have a height that corresponds to the height of the traffic door 40. In other words, the leading edge frame member 86 may extend the full height of the traffic door 40. Thus in an exemplary embodiment, the tubular beam 124 may have a height of about 81 inches (+/−5%). In an alternative embodiment, the leading edge frame 86 may extend substantially the full height of the traffic door 40, such as 90%, preferably 95%, and even more preferably 98% or greater of the full height of the traffic door 40.

Similarly, the lengths $L_{tb}$, $L_{bb}$ of the top edge beam 126 and the bottom edge beam 128, respectively, also depend on the size of the doorway 42 and on whether the doorway 42 is being closed off by a single traffic door (as illustrated in FIG. 2) or a pair of traffic doors (not shown). In an exemplary embodiment, the traffic door 40 may have a width (not including the central tab 80) of between about 28 inches and about 34 inches, more preferably between about 30 inches and about 32 inches, and even more preferably about 31 inches. The top edge frame member 90 and the bottom edge frame member 92 may be configured to have lengths that correspond to the width of the traffic door 40. Thus in an exemplary embodiment, the tubular beams 126, 128 may have a length of about 31 inches (+/−5%). These dimensions are exemplary and it should be recognized that other lengths are possible and remain within the scope of the present disclosure.

In an exemplary embodiment, the leading edge frame member 86, top edge frame member 90 and the bottom edge frame member 92 may be formed through an extrusion process using a suitable engineering plastic material. The extrusion process is well known to those of ordinary skill in the traffic door industry and a further description of such a process will not be provided herein. In an exemplary embodiment, these frame members 86, 90, 92 may be formed from acrylonitrile butadiene styrene (ABS). However, other thermoplastic polymers may also be possible, including polyethylene (PE), polypropylene (PP), polyvinyl chloride (PVC), and other materials. A strip having the configuration of the tubular beam 124 may be provided in stock lengths, which strip(s) are then cut to size to form the frame members 86, 90, 92 for a particular application.

Referring back to FIGS. 6 and 7, in addition to the peripheral frame portion 82, the frame 58 may include an internal frame portion 84 to provide additional strength to the traffic door 40. As illustrated in these figures, the internal frame portion 84 may include a plurality of horizontal supports 154 and vertical supports 156 arranged within the peripheral frame portion 82. The supports 154 and 156 may have a wide variety of arrangements and aspects of the invention should not be limited to the particular arrangement shown and described herein. In an exemplary embodiment, in addition to increasing the overall strength of the traffic door 40 the supports 154, 156 may be arranged to provide support for various features of the traffic door 40.

By way of example and without limitation, the internal frame portion 84 may include a pair of horizontal supports 154*a*, 154*b* that provide the upper and lower framework for the window 54. In a similar manner, the internal frame portion 84 may include a pair of vertical supports 156*a*, 156*b* that provide the side framework for the window 54. In the exemplary embodiment, an additional horizontal support 154*c* may be provided adjacent the bottom edge frame member 92 to provide additional support in the region of impact with the material handling equipment. Moreover, in an exemplary embodiment additional vertical supports may be provided for supporting a bumper on at least one and preferably on both sides of the traffic door 40. Thus, for example, the interior frame portion 84 may include vertical supports 156*c* and 156*d* extending between the horizontal support 154*c* adjacent the bottom edge 72 of the door 40 and the lower window frame support 154*a*. The vertical supports 156*c*, 156*d* may be positioned to correspond to the attachment points for the one or more bumpers 52 coupled to the traffic door 40.

In an exemplary embodiment, the horizontal and vertical supports 154, 156 may be formed from a tubular beam 158 having a first dimension of about 0.5 inches (+/−5%) and a second dimension of about 1.5 inches (+/−5%) and thereby fit within the peripheral frame portion 82 relative to the front and rear walls 102, 104 of the tubular beam 100 of the trailing edge frame member 88 and the front and rear walls 130, 132 of the tubular beams 124, 126, 128 of the leading edge frame member 86, top edge frame member 90, and bottom edge frame member 92, respectively. It is noted that the vertical supports 156*c* and 156*d* may be formed by a pair of tubular beams 158 in abutment with each other, as illustrated in FIGS. 6 and 7. The lengths of the tubular beam 158 depend on the arrangement of the horizontal and vertical supports 154, 156 and the purpose of the supports (e.g., size/location of the window 54 or bumper 52 on the door 40). One of ordinary skill in the art will be able to determine the lengths of the horizontal and vertical supports 154, 156 to achieve a desired purpose.

In an exemplary embodiment, the tubular beam 158 that defines the supports 154, 156 may be formed through an extrusion process using a suitable engineering plastic material. In an exemplary embodiment, these supports 154, 156 may be formed from acrylonitrile butadiene styrene (ABS). However, other thermoplastic polymers may also be possible, including polyethylene (PE), polypropylene (PP), polyvinyl chloride (PVC), and other materials. A strip having the configuration of the tubular beam 158 may be provided in stock lengths, which strip(s) are then cut to size to form the supports 154, 156 for a particular application.

Figure 11:
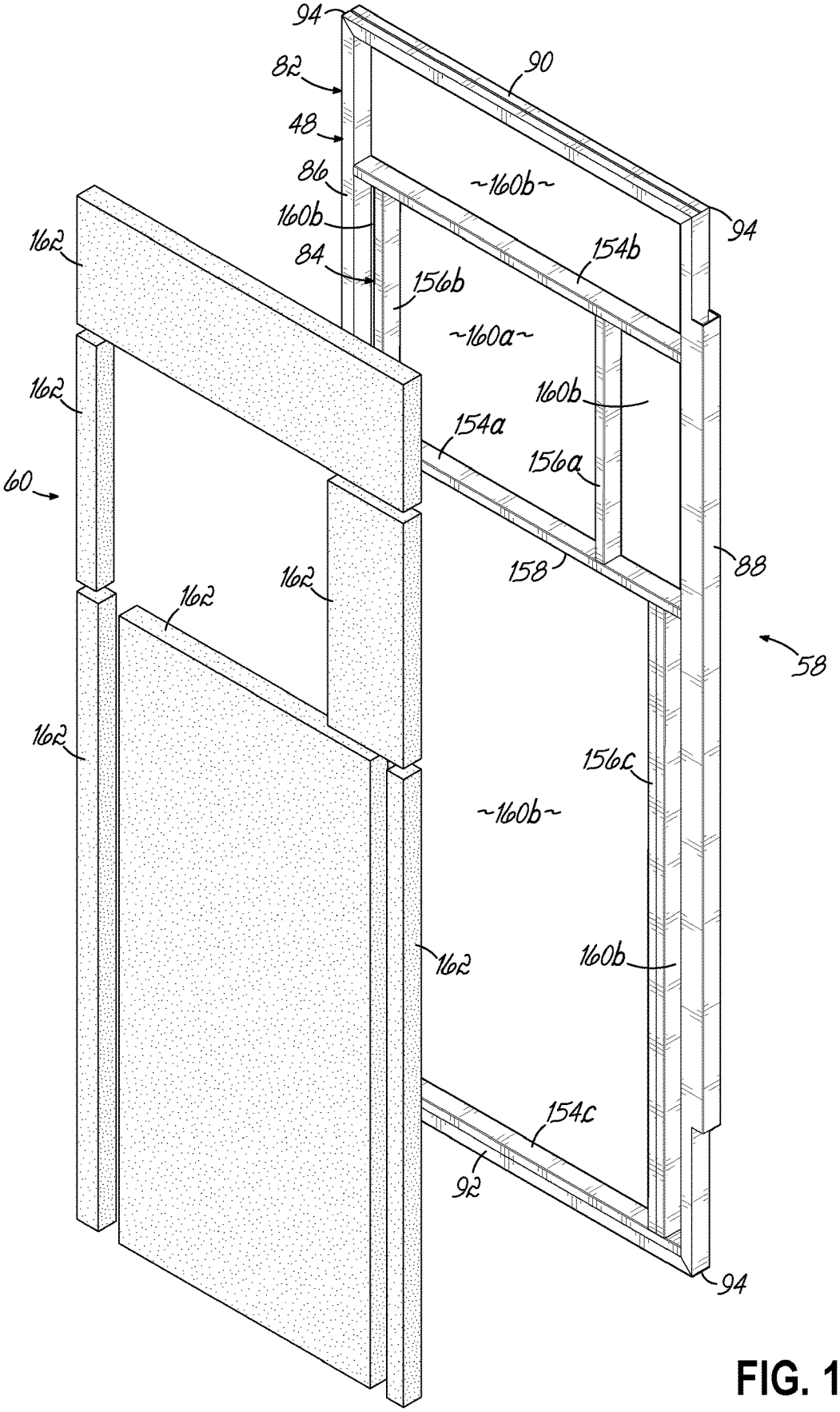
FIG. 11 is a front perspective disassembled view of a frame/filler assembly.

As illustrated in FIG. 6, when the peripheral frame portion 82 and interior frame portion 84 are coupled together to form frame 58, a number of chambers 160 are formed in the frame 58. The chambers 160 may serve different purposes. For example, one chamber may be configured as a window-receiving chamber 160*a*. One or more of the other chambers (e.g., the remaining chambers) may be configured as a filler-receiving chambers 160*b*. In an exemplary embodiment, and as illustrated in FIG. 11, the internal filler material 60 may take the form of a plurality of filler inserts 162. The filler inserts 162 are configured as sound-absorbing, impact-absorbing, and/or thermal barrier medium and may be made from foam, fiberglass or other suitable materials. For example, the filler inserts 162 may be formed from a polyisocyanurate foam.

Figure 12:
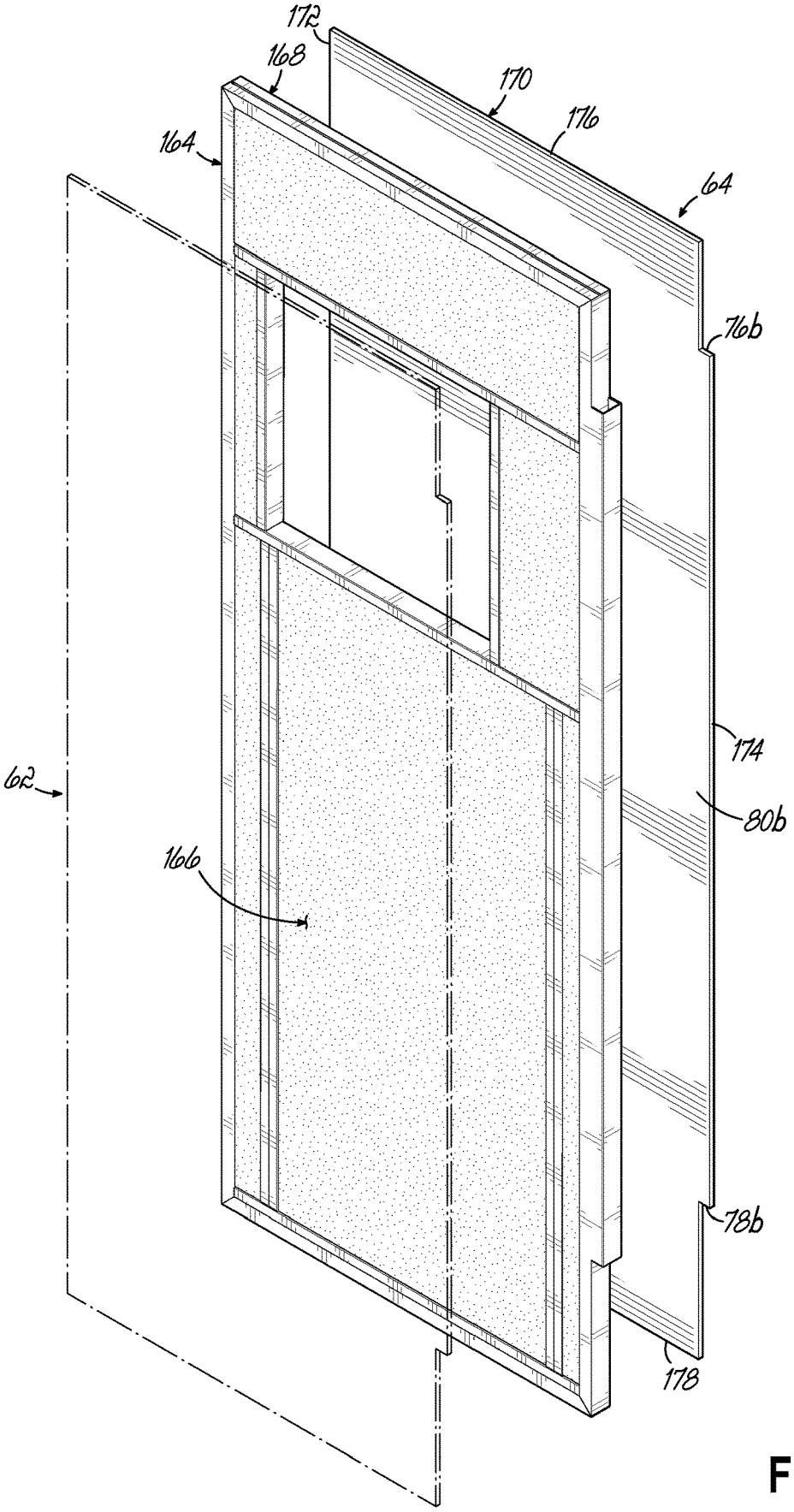
FIG. 12 is a front perspective disassembled view of the traffic door shown in FIG. 4.

The filler inserts 162 may be sized to correspond to a size of a respective filler-receiving chamber 160*b*, and thereby snugly fit within a respective chamber 160*b*. In an exemplary embodiment, for example, a large stock filler sheet may be provided, and the sheet(s) cut to form the various sized filler inserts 162 used for the traffic door 40. The filler inserts 162 have a thickness that corresponds to the thickness of the frame 58. Thus, for example, the filler inserts 162 may be about 1.5 inches (+/−5%). Other thickness dimensions are possible, however. As illustrated in FIG. 12, the filler inserts 162 may be positioned in their filler-receiving chambers 160*b*. The inserts 162 may be frictionally fit within the chambers 160*b* and may be bonded along their edges to the frame 58 using a suitable adhesive. This forms a frame/filler assembly 164 that defines first and second major surfaces 166, 168 with an edge formed by the peripheral frame portion 82. The major surfaces 166, 168 are generally smooth, planar surfaces. The face sheets 62, 64 are configured to be coupled to the major surfaces 166, 168 defined by the frame/filler assembly 164. The face sheets 62, 64 are substantially similar to each other and thus only the face sheet 64 will be described in detail but understanding that the description also applies to face sheet 62.

In an exemplary embodiment, face sheet 64 includes a thin, plate-like body 170 defining a leading edge 172, a trailing edge 174, a top edge 176, and a bottom edge 178. The face sheet 64 is sized to correspond to the outer dimension of the frame 58. Thus, the leading edge 172 generally aligns with the outer most edge of the leading edge frame member 86, the trailing edge 174 generally aligns with the outer most edge of the trailing edge frame member 88, the top edge 176 generally aligns with the outermost edge of the top edge frame member 90, and the bottom edge 178 generally aligns with the outmost edge of the bottom edge frame member 92. Thus, the trailing edge 174 of the face sheet 64 includes an upper cutout 76*b* and a lower cutout 78*b* that generally correspond to the upper and lower cutouts 76, 78 in the traffic door 40, respectively. The trailing edge 174 of the face sheet 64 also includes a central tab 80*b* that generally corresponds to the central tab 80 of the traffic door 40.

In an exemplary embodiment, the face sheets 62, 64 may be formed from a suitable engineering plastic material. In an exemplary embodiment, for example, the face sheets 62, 64 may be formed from polyvinyl chloride (PVC). However, the face sheet 62, 64 may be formed from other thermoplastic polymers, including polyethylene (PE), polypropylene (PP), acrylonitrile butadiene styrene (ABS). Other materials, including various metal materials may also be possible. In any event, to form the traffic door 40 the face sheets 62, 64 may be bonded to the major surfaces 166, 168 of the frame/filler assembly 164. By way of example and without limitation, the face sheets 62, 64 may be bonded to the frame 58 using a first bonding agent, such as an epoxy resin, and may be bonded to the filler material 60 using a second bonding agent, such as a contact cement. While the face sheets 62, 64 are described as being bonded to the frame/filler assembly 164, the face sheets 62, 64 may be attached to frame/filler assembly in other ways, such as by welding or using fasteners.

With the traffic door 40, and more particularly the door body 48 of the traffic door, described in detail above, a method of making the traffic door 40 will now be described. In a first step, the frame 58 may be assembled. To this end, a stock strip having the configuration of the tubular beam 100 as described above may be cut to the appropriate size (e.g., the height of the traffic door 40) to form the trailing edge frame member 88. Once the strip is cut to size to form the trailing edge frame member 88, the upper and lower cutouts 76*a*, 78*b* may be formed in the frame member 88. In this regard, a suitable tool may cut away part of the trailing edge frame member 88 to form the cutouts 76*a*, 78*b*. More particularly, the central web 110 may act as a cutting guide for this process. Additionally, a miter saw or other suitable tool may be used to form a miter at both ends of the trailing edge frame member 88.

In a similar manner, a stock strip having the configuration of the tubular beam 124 as described above may be cut to size to form the leading edge frame member 86, the top edge frame member 90 and the bottom edge frame member 92. A miter may also be formed at the ends of each of these frame members as well. Furthermore, a stock strip having the configuration of the tubular beam 158 as described above may be cut to size to form the horizontal and vertical supports 154, 156 that form the interior frame portion 84. With all of the members of the peripheral and interior frame portions 82, 84 cut to the appropriate size, the members may be, for example, placed on a working surface and coupled together to form the frame 58. To this end, the L-shaped brackets 96 may be placed at the ends of the peripheral frame members 86, 88, 90, 92 (e.g., in cavities 122, 152) to aid in fixing the frame 58 together. A bonding agent, such as an epoxy resin, may be used to bond the various frame members and supports together to form the frame 58. That process results in a frame 58 as illustrated in FIG. 6. While in an exemplary embodiment, bonding is used to couple the frame 58 together, in an alternative embodiment, the frame 58 may be assembled through other means, such as by welding or by fasteners.

In a next step, the filler material 60, and more particularly the filler inserts 162, may be added to the frame 58. In this regard, a stock sheet of filler material may be cut to size to form the different filler inserts 162. Once cut, the filler inserts 162 may be positioned within respective chambers 160*b* in the frame 58. The filler inserts 162 may be frictionally fit within their respective chambers 160*b*. Additionally or alternatively, the filler inserts 162 may be bonded to the frame 58, such as with a contact cement or other bonding agent. This process results in frame/filler assembly 164 as illustrated in FIG. 12.

In a further step, one of the face sheets 62, 64 may be bonded to one of the major surfaces 166, 168 of the frame/filler assembly 164. In this regard, a first bonding agent, such as an epoxy resin, may be applied to a surface of the frame 58 and a second bonding agent, such as a contact cement, may be applied to a surface of the filler inserts 162. The face sheet, e.g., face sheet 62, may then be applied to the frame/filler assembly 164 having the bonding agent applied thereto. After curing, that assembly may be flipped over on the working surface. The other face sheet 64 may then be bonded to major surface 168 of the frame/filler assembly 164. In a similar manner, the first bonding agent may be applied to a surface of the frame 58 and a second bonding agent may be applied to a surface of the filler inserts 162. The face sheet 64 may then be applied to the frame/filler assembly 164 having the bonding agent applied thereto.

When the face sheets 62, 64 are coupled to the frame/filler assembly 164, the upper and lower cutouts 76*b*, 78*b* may not be formed in the face sheets 62, 64. Thus, in a subsequent step, those upper and lower cutouts 76*b*, 78*b* may be formed in both face sheets 62, 64. To this end, a suitable tool may be used to cut away a portion of the face sheets 62, 64 along the top edge 176 and bottom edge 178 to form the cutouts 76*b*, 78*b*. In this regard, the central web 110 of the trailing edge frame member 88 may operate as a cutting guide for this process. Furthermore, when the face sheets 62, 64 are coupled to the frame/filler assembly 164, they may be solid panels and thus do not include any openings that correspond to the window 54 in the traffic door 40. Thus in another step, openings in the face sheets 62, 64 sized to correspond with the window-receiving chamber 160*a* may be formed. To this end, a suitable tool may be used to cut away a portion of the face sheets 62, 64 to provide the openings for the window 54. In this regard, the pair of horizontal supports 154*a*, 154*b* and vertical supports 156*a*, 156*b* that frame the window 54 may operate as a cutting guide for this process. The window 54 may then be positioned in the traffic door 40 and secured to the frame 58 in a known manner.

In yet another step, the bumpers 52 may be coupled to the traffic door 40. To this end, the bumper 52 may include a first end 182 and a second end 184 that generally align with the vertical supports 156*c*, 156*d*, respectively, of the frame 58. Fasteners, such as screws, rivets, or the like, may then be used to secure the ends 182, 184 to the vertical supports 156*c*, 156*d*. A bumper 52 may be coupled to one or both sides of the traffic door 40.

Figure 3:
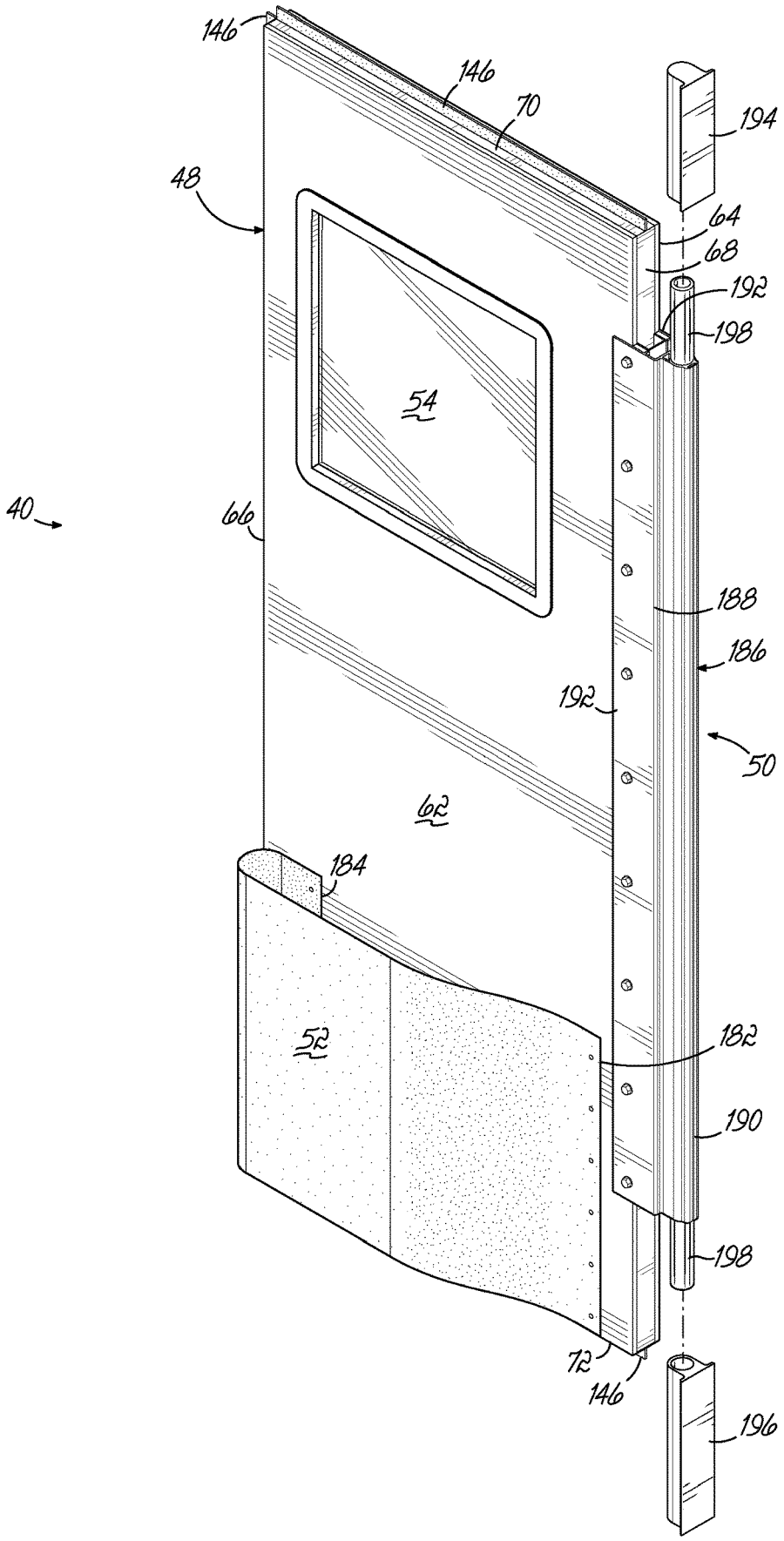
FIG. 3 is another front perspective view of the traffic door shown in FIG. 2 with a hinge mechanism.
Figure 4:
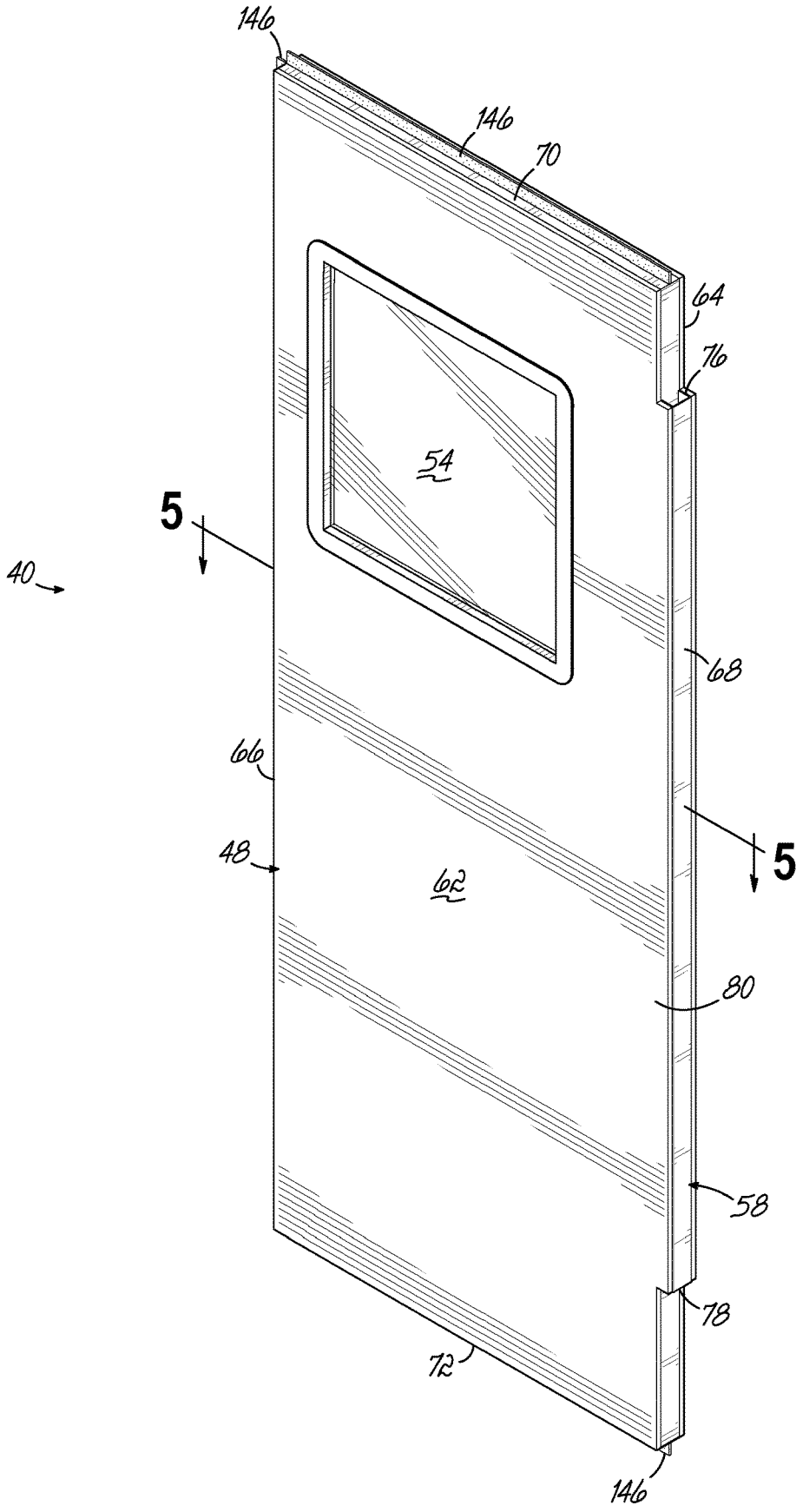
FIG. 4 is another front perspective view of a traffic door shown in FIG. 3 without the hinge mechanism.

In a further aspect, at least a portion of the hinge mechanism 50 may be coupled to the door body 48 of the traffic door 40 to facilitate the coupling of the traffic door 40 within the doorway 42. As shown in FIGS. 2 and 3, the hinge mechanism 50 may include a spine 186 attached to the door body 48 at the trailing edge 68 of the traffic door 40. In an exemplary embodiment, the spine 186 includes a U-shaped portion 188 and a circular portion 190. The U-shaped portion 188 includes a pair of opposed legs 192 that receive the trailing edge 68 of the door body 48 therebetween and which generally overlie the face sheets 60, 62 of the traffic door 40. In one embodiment, the spine 186 generally extends substantially along the full length of the central tab 80 of the traffic door 40, as illustrated in FIG. 2. Additionally, the legs 192 are generally wider than the width of the central tab 80 so as to extend beyond the trailing edge 68 define by the upper and lower cutouts 76, 78. Fasteners, such as screws, rivets, or the like may then be used to secure the spine 186 to the trailing edge frame member 88.

Subsequently, the traffic door 40 may be mounted to the doorway 42 in a conventional manner. For example, an upper jamb mount 194 may be attached to the upper end of the jamb of the doorway 42 and a lower jamb mount 196 may be attached to the lower end of the jamb of the doorway 42. The upper jamb mount 194 may be, for example, a V-cam mount, and the lower jamb mount 196 may be a convention pivot mount. These mounts are known to those of ordinary skill in the art and will not be described further. The spine 186 of the traffic door 40 is then operably coupled to the upper and lower jamb mounts 194, 196 through pivot tubes 198 that are received in the circular portion 190 of the spine 186, as illustrated by FIGS. 2 and 3.

Figure 13:
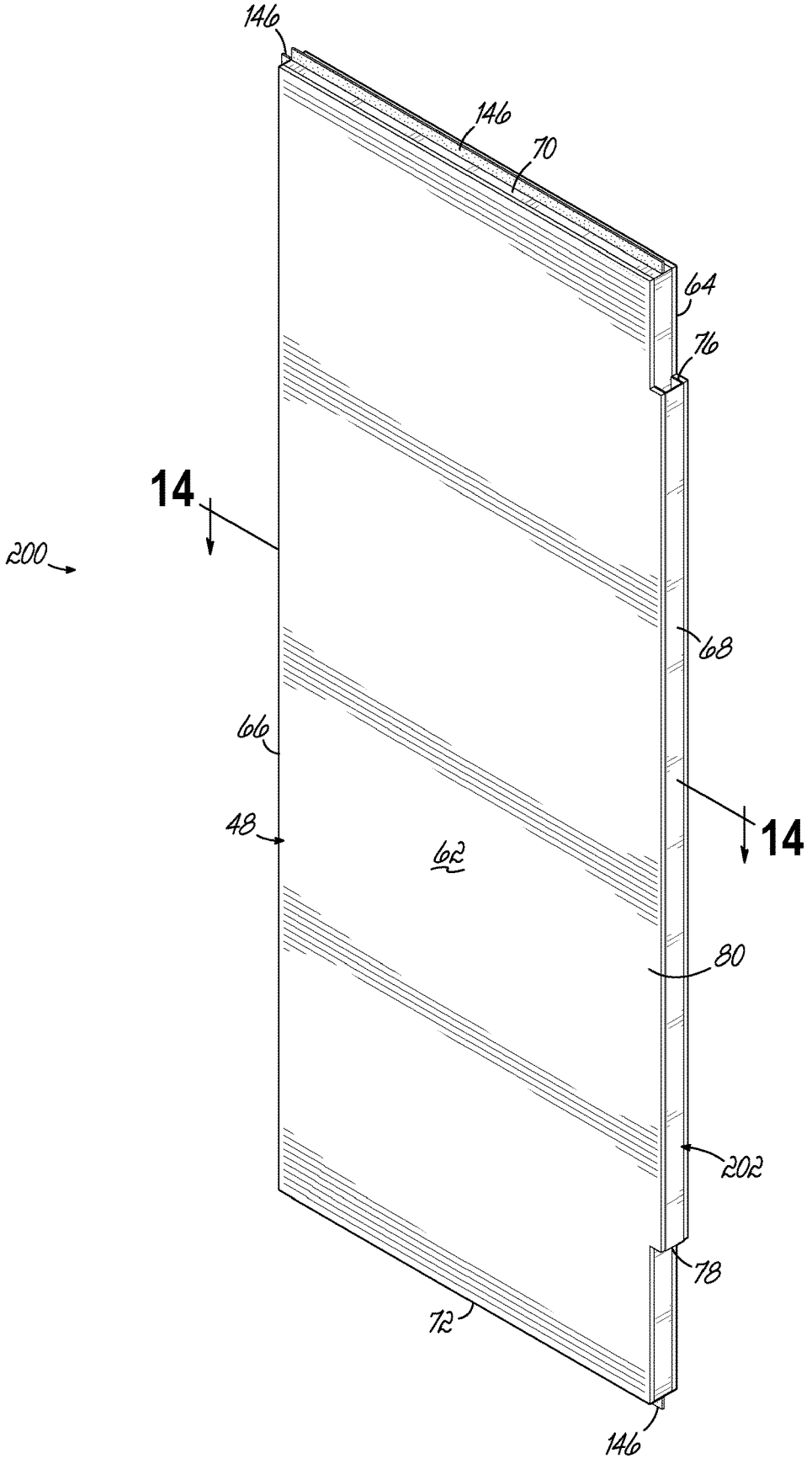
FIG. 13 is a front perspective view of a traffic door in accordance with another embodiment of the disclosure.
Figure 14:
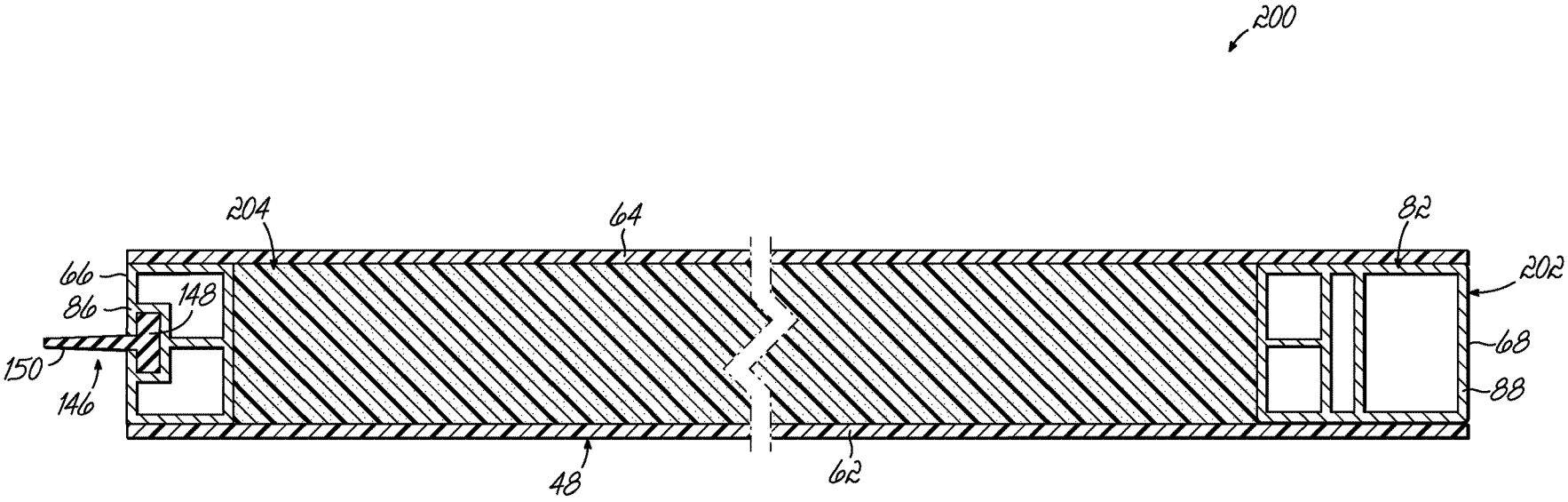
FIG. 14 is a cross-sectional view of the traffic door shown in FIG. 13.

FIGS. 13 and 14 illustrate an embodiment of a traffic door 200 in accordance with an alternative embodiment of the invention. The traffic door 200 is similar to traffic door 40 and only the differences with be described in detail. The primary difference between the two traffic doors is with the construction of the frame 202 and the manner in which the filler material 204 may be provided for the traffic door 200. More particularly, in this embodiment, the frame 202 includes only the peripheral frame portion 82. In other words, the interior frame portion 84 has been omitted in this embodiment. This essentially allows the filler material 60 to be a single, continuous, monolithic member disposed within the interior of the peripheral frame portion 84. As such, the method of manufacturing the traffic door 200 may be slightly modified.

For example, in an exemplary embodiment once the frame 202 has been assembled in the manner described above (but for omitting the interior frame portion 84), the face sheets 62, 64 may be applied to the frame 202 without the filler material 60 being positioned in the frame 202. The face sheets 62, 64 may be applied in the manner described above. This results in a hollow assembly. In this embodiment, a flowable filler material 204 may be injected into the hollow space of the assembly. For example, a foam-in-place process may be implemented to position the filler material 204 in the traffic door 200. In this regard, an injection port (not shown) may be provided in the trailing edge 68 of the traffic door 200 to provide an access point for introducing the injectable filler material 204. Once the filler material 204 has cured, the traffic door 200 may have an opening formed therethrough for receiving a window 54. Additionally, the one or more bumpers 52 and the spine 186 of the hinge mechanism 50 may be coupled to the traffic door 200 after the filler material 204 has cured.

While the present disclosure has been illustrated by the description of specific embodiments thereof, and while the embodiments have been described in considerable detail, it is not intended to restrict or in any way limit the scope of the appended claims to such detail. The various features discussed herein may be used alone or in any combination within and between the various embodiments. Additional advantages and modifications will readily appear to those skilled in the art. The disclosure in its broader aspects is therefore not limited to the specific details, representative apparatus and methods and illustrative examples shown and described. Accordingly, departures may be made from such details without departing from the scope of the disclosure.

What is claimed is:

1. A frame of a traffic door having a leading edge, a trailing edge, a top edge, and a bottom edge with outer opposing surfaces defined by opposing face sheets bonded to opposing sides of the frame, the trailing edge configured to couple to a hinge mechanism for mounting the traffic door to a doorway, the frame comprising:

a trailing edge frame member having a first end and a second end and opposing sides to which face sheets are to be bonded and configured to extend along the trailing edge of the traffic door, wherein the trailing edge frame member is a monolithic body that defines a first portion and a second portion, wherein the first portion extends between the first end and the second end in a continuous and linear manner, and wherein the trailing edge frame member includes a first cutout from the second portion of the trailing edge frame member adjacent the first end and a second cutout from the second portion of the trailing edge frame member adjacent the second end to define a central tab projecting away from the first portion.

2. The frame of claim 1, wherein the trailing edge frame member is formed by a tubular beam having a central web, wherein a portion of the tubular beam to one side of the central web defines the first portion of the trailing edge frame member, and wherein a portion of the tubular beam to the other side of the central web defines the second portion of the trailing edge frame member.

3. The frame of claim 2, further comprising an internal support positioned in the first portion of the trailing edge frame member.

4. The frame of claim 3, wherein the internal support defines at least one cavity in the first portion of the trailing edge frame member configured to receive a fixation bracket.

5. The frame of claim 1, wherein the frame further comprises a leading edge frame member, a top edge frame member, and a bottom edge frame member configured to respectively extend along the leading edge, top edge, and bottom edge of the traffic door.

6. The frame of claim 5, wherein the leading edge frame member, top edge frame member, and bottom edge frame member are each formed by a tubular beam having the same cross-sectional profile.

7. The frame of claim 6, wherein the cross-sectional profile of the tubular beam that forms each of the leading edge frame member, top edge frame member, and bottom edge frame member includes an interior cavity and a slot through a wall of the tubular beam open to the cavity, and wherein the cavity is configured to receive a seal having a portion that extends through the slot.

8. The frame of claim 7, wherein the cross-sectional profile of the tubular beam that forms each of the leading edge frame member, top edge frame member, and bottom edge frame member further includes at least one additional cavity configured to receive a fixation bracket.

9. The frame of claim 5, wherein the leading edge frame member, trailing edge frame member, top edge frame member, and bottom edge frame member are coupled together to form a peripheral frame portion.

10. The frame of claim 9, further comprising an interior frame portion positioned within and coupled to the peripheral frame portion.

11. The frame of claim 9, wherein the interior frame portion further comprises:

a plurality of supports that form a frame of a window for the traffic door; and/or a plurality of supports for attachment of one or more bumpers for the traffic door.

12. A traffic door having a leading edge, a trailing edge, a top edge and a bottom edge, the traffic door comprising:

a frame according to claim 1;

a filler material positioned within the frame;

a first face sheet coupled to a first side of the frame; and a second face sheet coupled to a second side of the frame.

13. The traffic door of claim 12, wherein the frame further comprises a leading edge frame member, a top edge frame member, and a bottom edge frame member configured to respectively extend along the leading edge, top edge, and bottom edge of the traffic door, and wherein the leading edge frame member, trailing edge frame member, top edge frame member, and bottom edge frame member are coupled together to form a peripheral frame portion.

14. The traffic door of claim 13, wherein the filler material comprises a single monolithic body that substantially fills the space between the peripheral frame and the first and second face sheets.

15. The traffic door of claim 12, further comprising a window and/or one or more bumpers.

16. The traffic door of claim 13, further comprising an interior frame portion positioned within and coupled to the peripheral frame portion, the frame defining a plurality of chambers.

17. The traffic door of claim 16, wherein the filler material comprises a plurality of filler inserts each positioned within a respective one of the plurality of chambers defined by the frame.

18. A method of making a frame of a traffic door with outer opposing surfaces defined by opposing face sheets bonded to opposing sides of the frame, comprising:

providing a tubular beam having a first end and a second end and opposing sides to which face sheets are to be bonded, wherein the tubular beam is a monolithic body having a central web that defines a first portion and a second portion, wherein the first portion extends between the first end and the second end in a continuous and linear manner;

forming a first cutout from the second portion of the tubular beam adjacent the first end; and forming a second cutout from the second portion of the tubular beam adjacent the second end to define a central tab projecting away from the first portion.

19. A method of making a traffic door having a leading edge, a trailing edge, a top edge and a bottom edge, the method comprising: assembling a frame that supports the traffic door, wherein the frame includes a trailing edge frame member made according to the method of claim 18; inserting a filler material within the frame; coupling a first face sheet to a first side of the frame; and coupling a second face sheet to a second side of the frame.

20. The method of claim 19, wherein the frame further comprises a leading edge frame member, a top edge frame member, and a bottom edge frame member configured to respectively extend along the leading edge, top edge, and bottom edge of the traffic door, wherein assembling the frame further comprises coupling the leading edge frame member, trailing edge frame member, top edge frame member, and bottom edge frame member together to form a peripheral frame portion.

21. The method of claim 20, wherein inserting the filler material within the frame further comprises injecting a flowable filler material into the space defined by the peripheral frame and the first and second face sheets.

22. The method of claim 20, further comprising attaching a seal to at least one of the leading edge frame member, top edge frame member, and bottom edge frame member.

23. The method of claim 20, wherein assembling the frame further comprises forming an interior frame portion within the peripheral frame portion to define a plurality of chambers.

24. The method of claim 23, wherein inserting the filler material within the frame further comprises inserting a filler insert within at least some of the plurality of chambers.

25. The method of claim 19, further comprising forming a first cutout from each of the first and second face sheets corresponding to the first cutout in the trailing edge frame member, and forming a second cutout from each of the first and second face sheets corresponding to the second cutout in the trailing edge frame member to define a central tab corresponding to the central tab of the trailing edge frame member.

26. The method of claim 19, further comprising forming a window through the traffic door and/or attaching one or more bumpers to at least one of the face sheets of the traffic door.

* * * * *